US009805899B2

(12) United States Patent
Wang et al.

(10) Patent No.: US 9,805,899 B2
(45) Date of Patent: Oct. 31, 2017

(54) SWITCH MODULE OF BUILT-IN ANTI-SURGE DISCONNECTION STRUCTURE

(71) Applicants: Yi-Hsiang Wang, Taoyuan (TW); I-Ying Wang, Taoyuan (TW)

(72) Inventors: Yi-Hsiang Wang, Taoyuan (TW); I-Ying Wang, Taoyuan (TW)

( * ) Notice: Subject to any disclaimer, the term of this patent is extended or adjusted under 35 U.S.C. 154(b) by 51 days.

(21) Appl. No.: 14/950,069

(22) Filed: Nov. 24, 2015

(65) Prior Publication Data

US 2017/0148601 A1 May 25, 2017

(51) Int. Cl.
*H01H 89/04* (2006.01)

(52) U.S. Cl.
CPC ..... *H01H 89/04* (2013.01); *H01H 2205/002* (2013.01); *H01H 2235/01* (2013.01)

(58) Field of Classification Search
CPC ..... H01H 89/04; H01H 2235/01; H01H 2205/002; H01H 37/761; H01H 37/34; H01H 2037/762; H01H 61/02; H01H 13/14; H01H 2223/00; H01H 85/36; H01H 85/08; H01H 85/175; H01H 23/105; H02H 3/38; H01C 7/12
USPC ..... 337/337, 59, 132, 345, 397
See application file for complete search history.

(56) References Cited

U.S. PATENT DOCUMENTS 3,562,689 A * 2/1971 Bar ..... H01H 23/025 337/77
4,345,233 A * 8/1982 Matthies ..... H01H 23/00 307/141
6,876,290 B2 * 4/2005 Yu ..... H01H 73/30 337/56
7,248,140 B2 * 7/2007 Yu ..... H01H 73/26 337/56
7,688,174 B2 * 3/2010 Hung ..... H01H 23/025 337/56
2001/0006145 A1 * 7/2001 Yu ..... H01H 73/30 200/524
2003/0102953 A1 * 6/2003 Wang ..... H01H 73/26 337/37
2011/0109421 A1 * 5/2011 Lee ..... H01H 9/0271 337/112

* cited by examiner

*Primary Examiner* — Anatoly Vortman
*Assistant Examiner* — Stephen Sul
(74) *Attorney, Agent, or Firm* — Rosenberg, Klein & Lee

(57) ABSTRACT

A switch module of built-in anti-surge disconnection structure mainly comprises an overcurrent protection switch and an anti-surge disconnection structure ingeniously built inside a heat-resisting housing. The switch module has a first connecting point and a second connecting point for operation. When overvoltage occurs, the temperature of at least one metal oxide varistor would instantly rise up to a degree higher than the melting point thereof, melting at least one thermo-sensitive piece, loosening at least one spring element, displacing a pushing element, and thus forcing the connecting points detaching from each other to turn off the switch and stop supplying the electricity power, so as to ensure more of electricity safety. Also, the switch module has the colloid thermo-sensitive piece directly fixing the spring element instead of having a band for fixing in the prior art, achieving an easier manufacturing process and better effectiveness of the switch module.

4 Claims, 12 Drawing Sheets

SWITCH MODULE OF BUILT-IN ANTI-SURGE DISCONNECTION STRUCTURE

BACKGROUND OF THE INVENTION

1. Field of the Invention

The present invention relates to a switch module of built-in anti-surge disconnection structure, particularly to an overcurrent protection switch that has anti-surge and disconnection structures built inside.

2. Description of the Related Art

FIGS. 1A and 1B disclose a conventional overcurrent protection switch 10 that has plural connecting points arranged in the middle part and comprises a housing 11 with a press button 12 on the top, a first terminal 12*a*, a second terminal 12*b*, a third terminal 12*c* separately arranged at the bottom, and a moving element 14. The first terminal 12*a* has a bimetal plate 13 and a first contact 131; the second terminal 12*b* has a second contact 121 corresponding to the first contact 131. The moving element 14 has one end linking the bottom of the press button 12 and the other linking the moving terminal of the bimetal plate 13, whereby the pressing of the press button 12 actuates the first contact 131 connecting to the second contact 121 and therefore turns on the device; while overcurrent occurs, the bimetal plate 13 deforms due to high degree of temperature and disconnects the first and second contact 131, 121, turning off the device so as to form an overcurrent protection switch 10. Such structure can be found in Taiwan patent applications No. 540811, 367091, 320335, 262168, and 208384. However, the structure disclosed above aims at protection from overcurrent situation but is not able to protect the device when sudden overvoltage such as lightning strike occurs.

Therefore, for safety concern, a usual solution to the defect is to parallel connect to a metal oxide varistor, and to connect to a thermal fuse in series.

FIG. 2A is the invention of U.S. Pat. No. 8,643,462. It discloses an anti-surge switch module applied in an electric system. The switch module comprises a power switch 105, an insulating member 106, a surge absorber 107 and a pyrocondensation belt 108. The insulating member 106 engages with the power switch 105 that abutting against the surge absorber 107; and the pyrocondensation belt 108 ties the surge absorber 107 and the insulating member 106 together so that it could contract when receiving the heat from the surge absorber 107 and thus turn off the power switch 105 under certain degree of contracting. However, the insulating member 106, the surge absorber 107 and the pyrocondensation belt 108 are not disposed inside the power switch 105 but are connected outside, failing to form a complete device with the power switch 105.

In short, the structures disclosed above have shortcomings as uncertain quality, possible exceeding heat due to external connection of components, slow reaction, large volumes, and complicated composition, and they require more constructing space and procedures. Besides, the protection device has to be connected independently outside instead of having one inside.

In UL 1449 3$^{rd}$ Edition (2009) Type 4 was added to Surge Protective Devices (SPDs) requirements. The 3$^{rd}$ Edition also includes the Low voltage Surge Arresters under 1000 V in the requirements, and the title is also altered from Transient Voltage Surge Suppressors into Surge Protective Devices. This shows the importance of integrating the components and the surge arresters function of the device.

Hence, the inventor has invented U.S. patent application Ser. No. 14/324,432, Ser. No. 14/617,000 and Ser. No. 14/824,211 to construct an anti-surge disconnection structure built inside a heat-resisting and fireproof housing of an overcurrent protection switch so that the disconnection could be operated successfully and instantly when an overload occurs. Still, the inventor has continued to develop such feature and further designed a switch module with easier manufacturing process and better effectiveness.

SUMMARY OF THE INVENTION

A primary object of the present invention is to provide a switch module of built-in anti-surge disconnection structure that has the original function of overcurrent protection and further includes an anti-surge and disconnection structure to ensure more of electricity safety. Also, the switch module has a colloid thermo-sensitive piece directly fixing the spring element instead of having a band for fixing, thus achieving an easier manufacturing process and better effectiveness.

To achieve the objects mentioned above, the present invention comprises a housing having a press button arranged atop thereof, and a first conductive plate, a second conductive plate and a third conductive plate arranged at a lower section thereof; the first conductive plate being connected to a binary alloy conductive plate and having a first connecting point, and the second conductive plate having a second connecting point on the surface of an upper section thereof corresponding to the first connecting point; a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

Wherein an anti-surge disconnection structure is built inside the housing, including at least one metal oxide varistor being disposed under a plate and having a first surface and an opposite second surface; at least one spring element having an outer periphery with an extended portion connecting the first surface of the metal oxide varistor with the second conductive plate, and a springy section being compressed on the first surface of the metal oxide varistor; at least one thermo-sensitive piece being solid colloid to be adhered on the first surface of the metal oxide varistor for fixedly adhering the springy section of the spring element on the first surface of the metal oxide varistor for the spring element to be ready for ejection; a pushing element having a first end thereof arranged correspondingly to the metal oxide varistor and the springy section of the spring element, and a second end thereof arranged correspondingly to the binary alloy conductive plate for pushing;

Whereby when the first connecting point is contacting the second connecting point and an overvoltage occurs, the temperature of the metal oxide varistor would instantly rise up to a degree higher than the melting point thereof, therefore melting the thermo-sensitive piece, loosening the springy section of the spring element and displacing the pushing element to force the first connecting point detaching from the second connecting point and turn off the switch.

Furthermore, in a second embodiment, the anti-surge disconnection structure includes a first metal oxide varistor being disposed under a plate and having a first surface and an opposite second surface; at least one spring element having an outer periphery with a first extended portion connecting the first surface of the first metal oxide varistor with the second conductive plate, and a springy section being compressed on the first surface of the first metal oxide varistor; at least one thermo-sensitive piece being solid colloid to be adhered on the first surface of the first metal oxide varistor for fixedly adhering the springy section of the spring element on the first surface of the first metal oxide varistor for the spring element to be ready for ejection; a second metal oxide varistor having a first surface and a opposite second surface; the first surface thereof compressing the spring element; an electrical connector abutting on the second surface of the second metal oxide varistor and having a second extended portion arranged aside for electrical connection between the second surface of the second metal oxide varistor and the third conductive plate; a pushing element having a first end thereof arranged correspondingly to the middle of the electrical connector and the second surface of the second metal oxide varistor, and a second end thereof arranged correspondingly to the binary alloy conductive plate for pushing.

What's more, in a third embodiment, the anti-surge disconnection structure includes at least one metal oxide varistor being disposed under a plate and having a first surface and an opposite second surface; at least one spring element having an outer periphery with an extended portion connecting the first surface of the metal oxide varistor with the second conductive plate, and a springy section being compressed on the first surface of the metal oxide varistor; at least one thermo-sensitive piece being solid colloid to be adhered on the first surface of the metal oxide varistor for fixedly adhering the springy section of the spring element on the first surface of the metal oxide varistor for the spring element to be ready for ejection; a pushing element having a first end thereof arranged correspondingly to the metal oxide varistor and the springy section of the spring element, and a second end thereof arranged correspondingly to the binary alloy conductive plate for pushing.

With structures disclosed above, the present invention complements the defect of a conventional overcurrent protection switch that it has to connect to a metal oxide varistor from the outside by having the anti-surge disconnection structure ingeniously built inside the heat-resisting and fireproof housing. When receiving exceedingly high voltages, the heating metal oxide varistor would instantly melt down the thermo-sensitive piece, loosening the springy section of the spring element for ejection and further displacing the pushing element, therefore forcing the first connecting point detaching from the second connecting point and turning off the switch immediately. Therefore, the present invention is not only overcurrent protective but also overvoltage protective and surge absorbing, ensuring more electricity safety and conveniences in using. Also, the switch module has the colloid thermo-sensitive piece directly fixing the spring element instead of having a band for fixing as in the prior art, thus achieving an easier manufacturing process and better effectiveness.

DETAILED DESCRIPTION OF THE PREFERRED EMBODIMENT

Figure 1A:
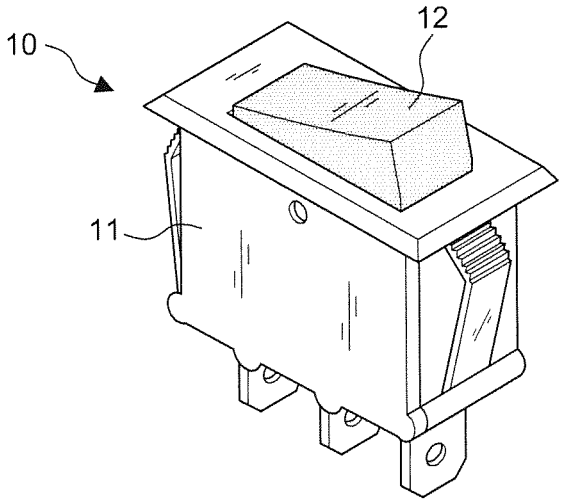
FIG.1A PRIOR ART
FIG. 1A is a perspective view of an overcurrent protection switch according to the prior art.
Figure 1B:
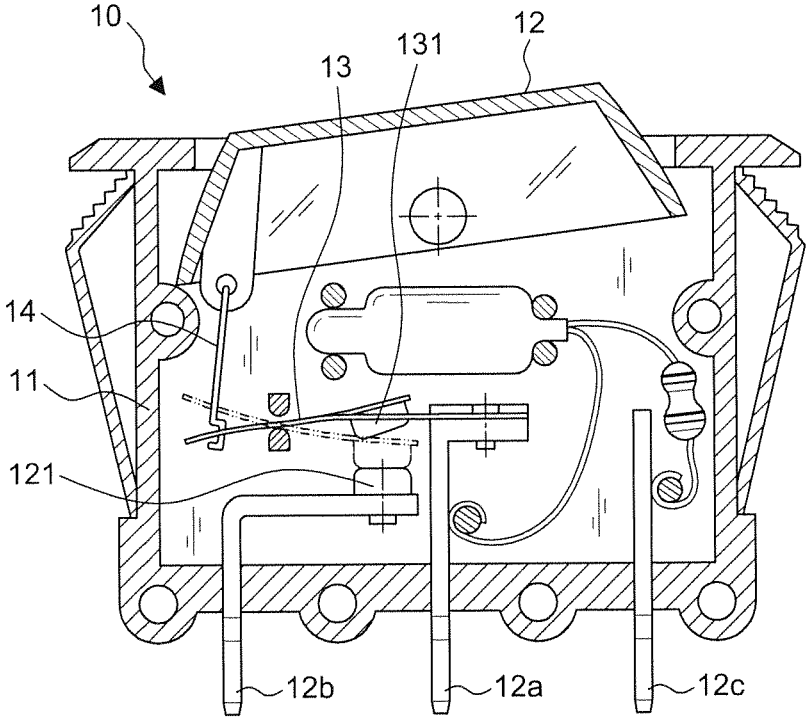
FIG.1B PRIOR ART
FIG. 1B is a section view of an overcurrent protection switch according to the prior art.
Figure 2:
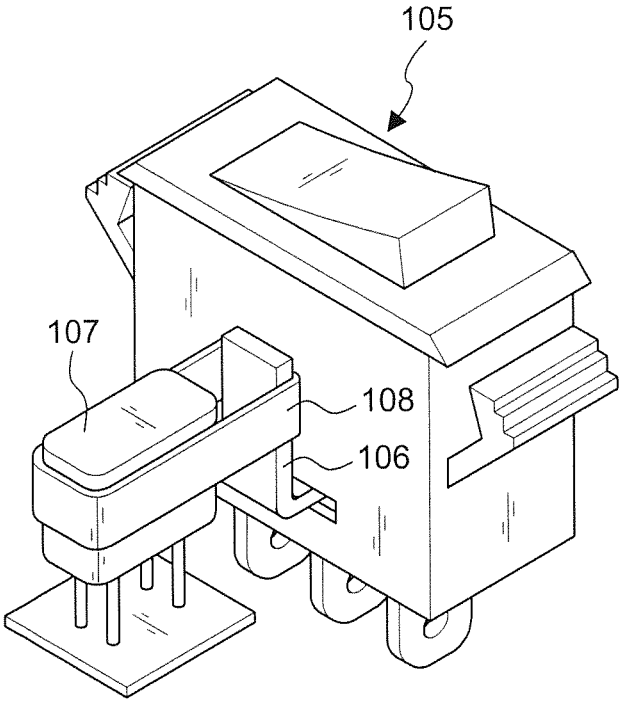
FIG.2 PRIOR ART
FIG. 2 is a perspective view of an anti-surge disconnection structure according to U.S. Pat. No. 8,643,462.

Referring to FIGS. 3-6, in a first embodiment, the present invention mainly includes a housing 31, a moving rod 33, and an anti-surge disconnection structure 70.

The housing 31 has a press button 32 arranged atop thereof, and a first conductive plate 40 for positive electrode input, a second conductive plate 50 for positive electrode output and a third conductive plate 60 for negative electrode input arranged at a lower section thereof. The first conductive plate 40 is connected to a binary alloy conductive plate 41 that has a spring leaf 42 and a first connecting point 421, and the second conductive plate 50 has a second connecting point 511 corresponding to the first connecting point 421.

Figure 3:
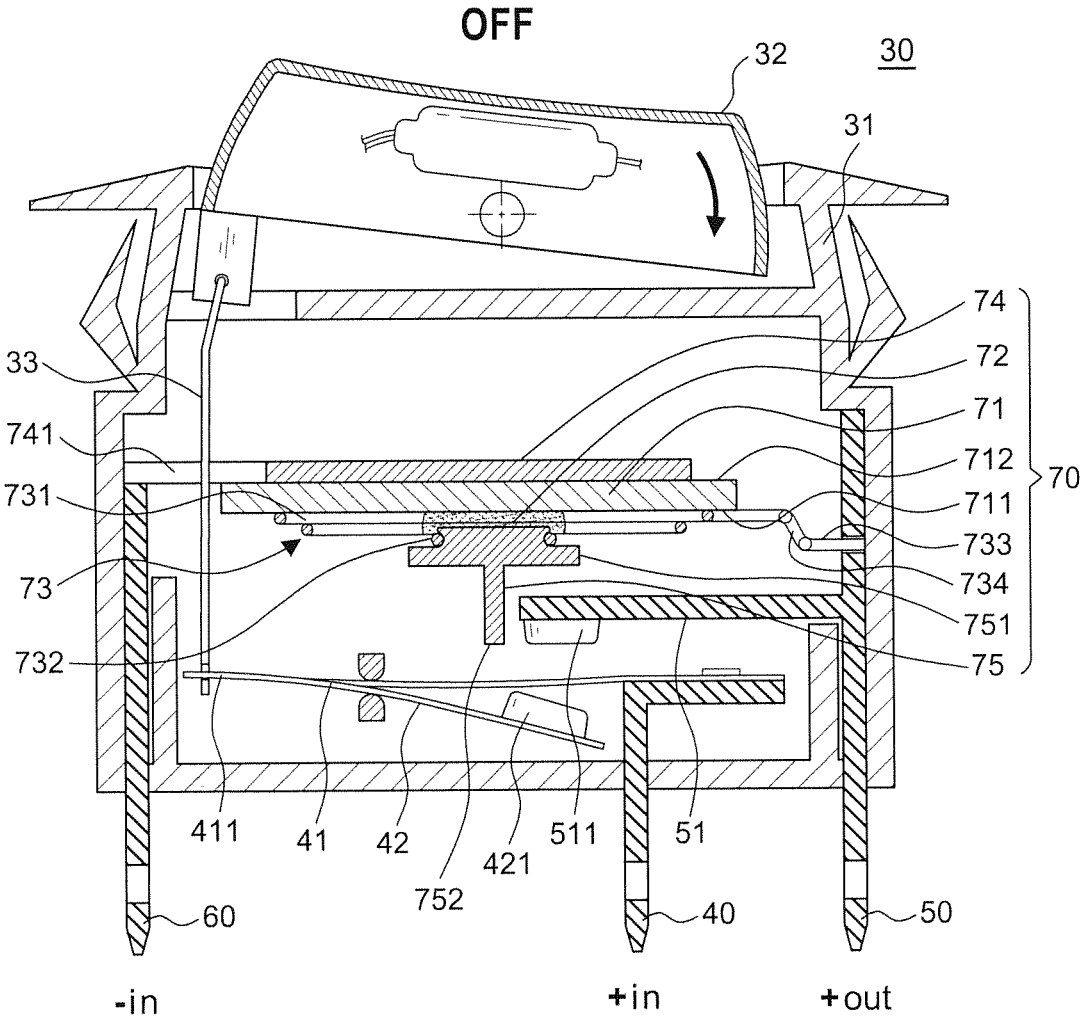
FIG. 3 is a sectional view of the present invention in a first embodiment in an OFF status.
Figure 4:
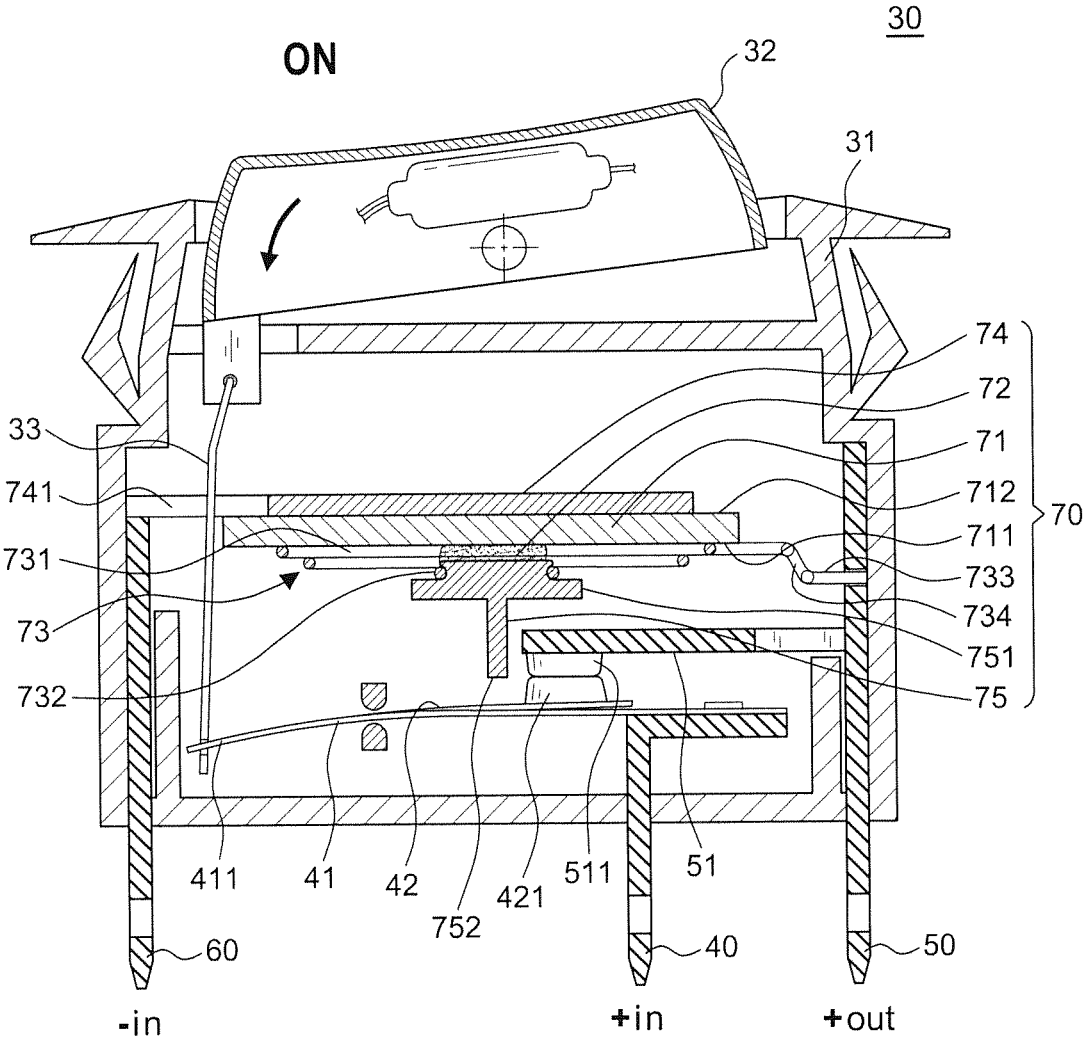
FIG. 4 is a sectional view of the present invention in the first embodiment in an ON status.

The moving rod 33 has a top end arranged at the bottom of the press button 32 and a bottom end connecting to a movable end 411 of the binary alloy conductive plate 41. With reference to FIG. 4, when pressing the press button 32, the binary alloy conductive plate 41 ejects upwards and the spring leaf 42 ejects downwards to make the first connecting point 421 contacting the second connecting point 511 and thus turn on the switch; when current overload occurs, the binary alloy conductive plate 41 deforms due to high temperature and detach the first connecting point 421 from the second connecting point 511 to turn the switch off back to the original status as shown in FIG. 3, so as to form a switch module 30 with an overcurrent protection switch.

The arrangement of the binary alloy conductive plate 41 and the press button 32 is different in various switch modules. In this embodiment, the binary alloy conductive plate 41 has the first connecting point 421 arranged on the spring leaf 42 but it is not limited to such application. The binary alloy conductive plate 41 can eject without the spring leaf 42 and the first connecting point 421 can be arranged aside the binary alloy conductive plate 41.

The features of the present invention lies in that the anti-surge disconnection structure 70 is built inside the housing 31 and includes at least one metal oxide varistor 71, at least one spring element 73, at least one thermo-sensitive piece 72, and a pushing element 75.

The metal oxide varistor 71 is disposed under a plate 74 and has a first surface 711 and an opposite second surface 712. In this embodiment, the first surface 711 is the positive electrode and the second surface 712 is the negative electrode; they are electrically connected to the second conductive plate 50 and the third conductive plate 60 by a predetermined connector which can be a conductive wire, a conductive plate, or a conductive element extended from the surface of the metal oxide varistor 71.

Figure 3A:
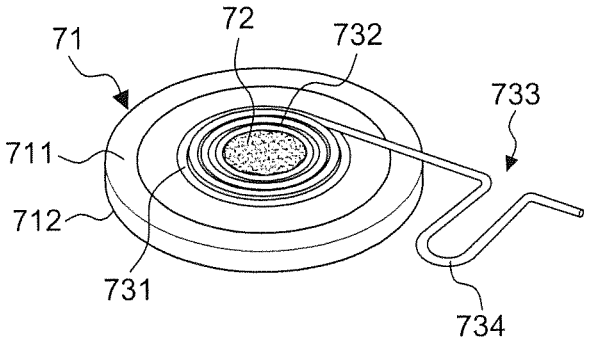
FIG. 3A is a perspective view illustrating the thermo-sensitive piece adhering the springy section of the spring element on the metal oxide varistor in FIG. 3.
Figure 6:
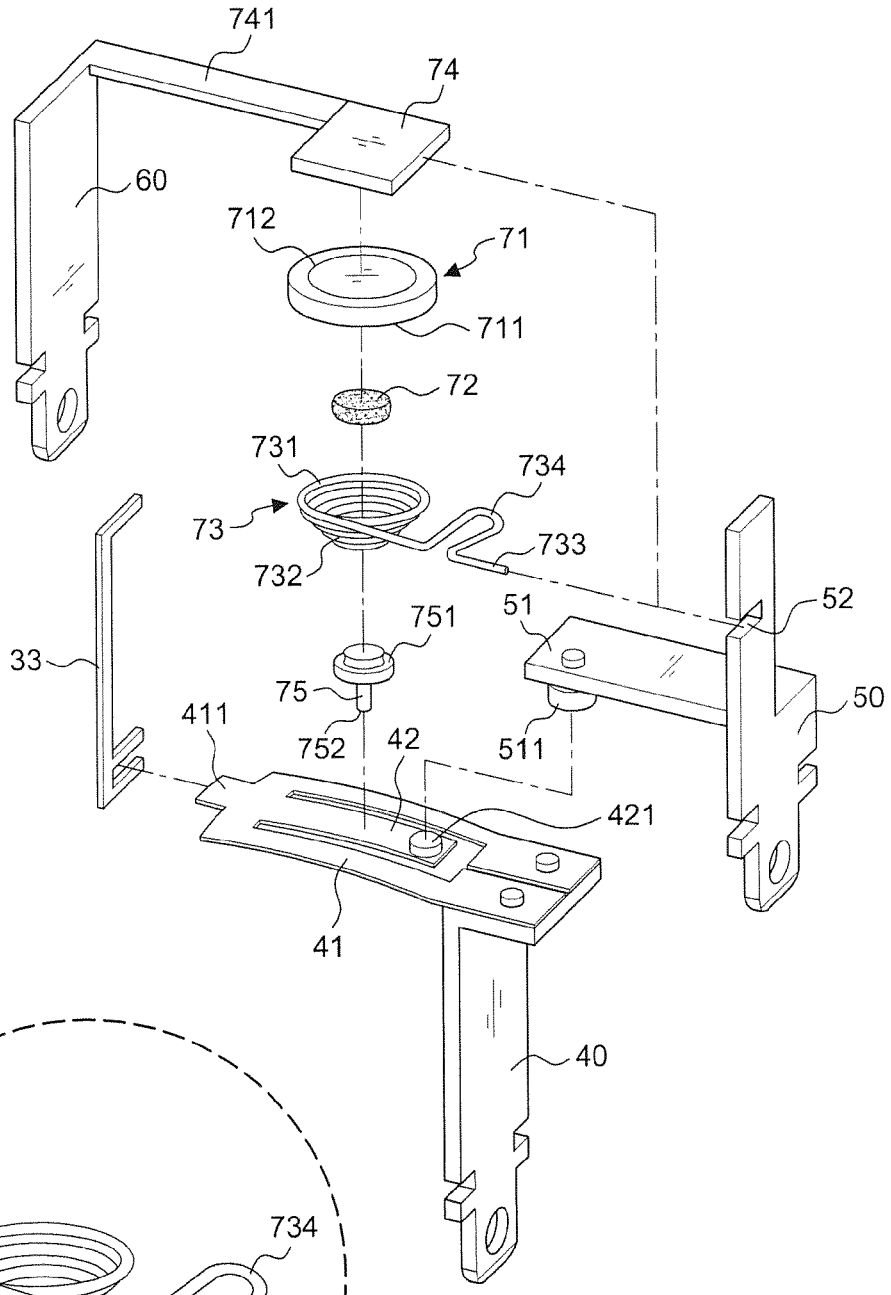
FIG. 6 is an exploded view of the major components of the present invention in the first embodiment.

The spring element 73 has an outer periphery 731 and a springy section 732 compressed on the first surface 711 of the metal oxide varistor 71 as shown in FIG. 3A. In this embodiment, there is one spring element 73 and the second surface 712 of the metal oxide varistor 71 is arranged under the plate 74; the plate 74 is arranged as a fixed surface for ejection and therefore it can be a conductive plate, a positioning plate together formed in one-piece with the housing 31, or an extended portion from the third conductive plate 60. The outer periphery 731 of the spring element 73 further has an extended portion 733 that is arranged as a bended portion 734 and connects the first surface 711 of the metal oxide varistor 71 with the second conductive plate 50. As shown in FIG. 6, the extended portion 733 has the bended portion 734 for engaging a first slot 52 arranged on the second conductive plate 50 so that when the spring element 73 is ejected, the bended portion 734 will provide stronger elasticity for ejection and then return to a straight status without affecting the operation. The second surface 712 of the metal oxide varistor 71 is connected to the third conductive plate 60 by the plate 74 and a conductive wire 741; in this embodiment, the plate 74 and conductive wire 741 are formed in one-piece extended from the third conductive plate 60.

The thermo-sensitive piece 72 is solid colloid to be adhered on the first surface 711 of the metal oxide varistor 71 for fixedly adhering the springy section 732 of the spring element 73 thereon for the spring element 73 to be ready for ejection. In this embodiment, the thermos-sensitive piece 72 is made of metal compounds that are fast-acting in low temperature, e.g. common metal compounds in producing fuses, but the present invention is not limited to such application; it can also be made of non-metal thermo-sensitive materials. In other words, materials those would melt at a pre-determined degree before the temperature of the metal oxide varistor 71 rises up to a high number would apply, conductive or not.

Figure 6A:
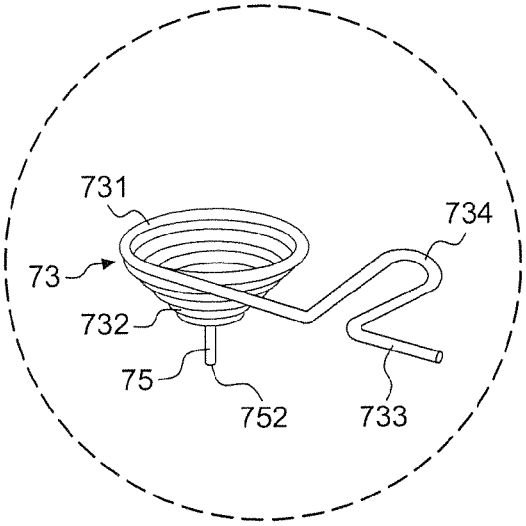
FIG. 6A is a schematic diagram illustrating the pushing element formed in one-piece with the spring element.

The pushing element 75 has a first end 751 arranged correspondingly to the metal oxide varistor 71 and the springy section 732 of the spring element 73, and a second end 752 arranged correspondingly to the binary alloy conductive plate 41 for pushing. In this embodiment, the pushing element 75 is an isolated pushing rod and the first end 751 is contacting the springy section 732. Furthermore, the first end 751 is arranged for engaging the springy section 732 in a preferred embodiment. When the spring element 73 is ejected, the first connecting point 421 on the binary alloy conductive plate 41 would be forced to detach from the second connecting point 511. In another applicable embodiment as shown in FIG. 6A, the pushing element 75 is formed in one-piece with the spring element 73 as a protruding section arranged at the front of the spring element 732.

Figure 5:
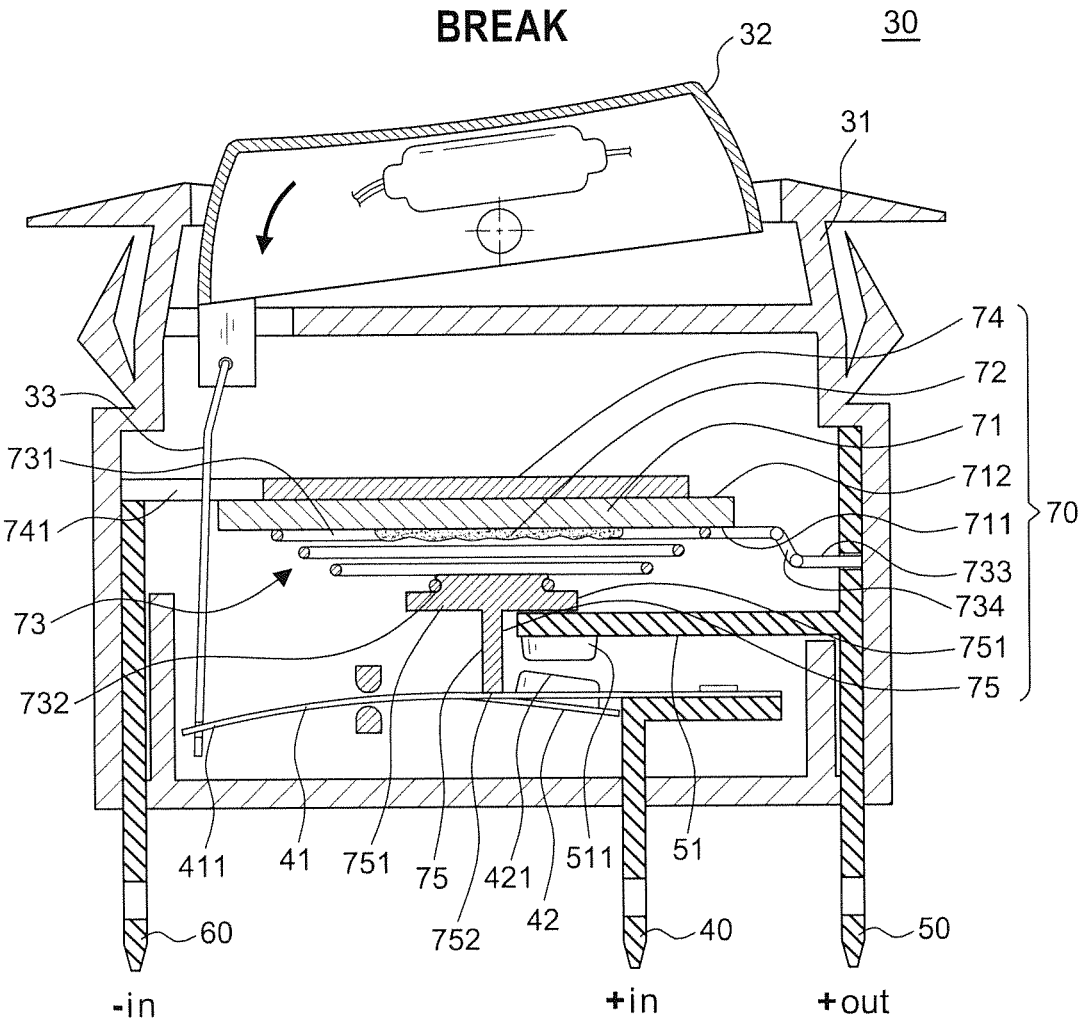
FIG. 5 is an application example of the present invention illustrating the thermo-sensitive piece melting, loosening the spring element, displacing the pushing element, and further turning the switch off.
Figure 5A:
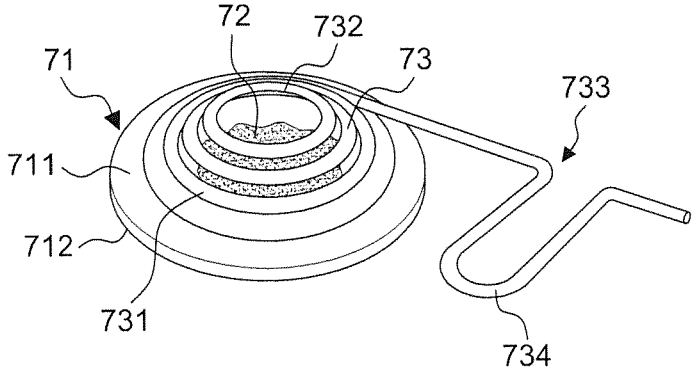
FIG. 5A is a perspective view illustrating the thermo-sensitive piece melting, loosening the springy section of the spring element in FIG. 5.

Further referring to FIGS. 5 and 5A, when the first connecting point 421 is contacting the second connecting point 511 and an overvoltage occurs, the temperature of the metal oxide varistor 71 would instantly rise up to a degree higher than the melting point of the thermo-sensitive piece 72, melting the thermo-sensitive piece 72, counterbalancing the compressing force on the spring element 73 and further displacing the pushing element 75, therefore forcing the first connecting point 421 detaching from the second connecting point 511 and turning off the switch without having the first conductive plate 40 deformed due to the high degree of temperature. Consequently, the metal oxide varistor 71 stops heating up and stops supplying electricity power for the device as well.

Figure 7:
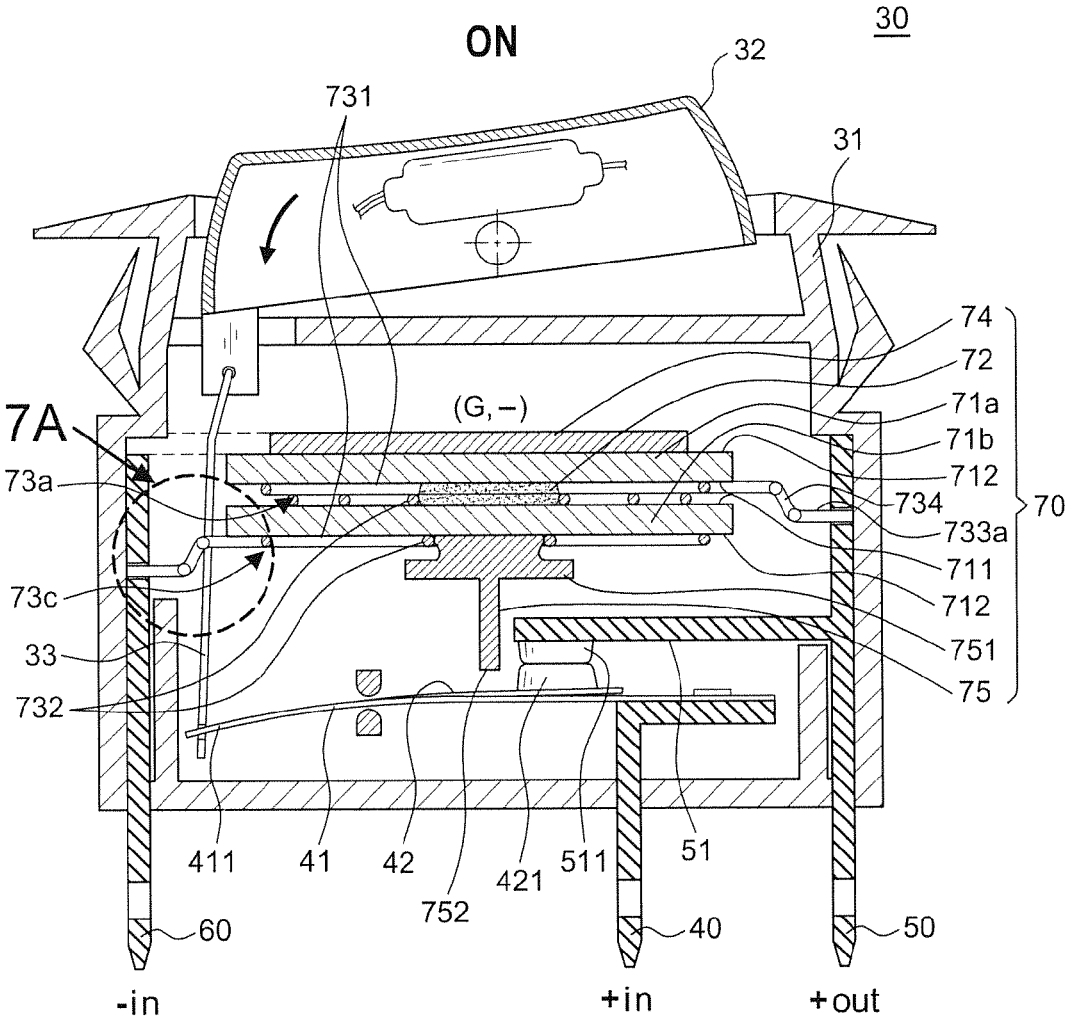
FIG. 7 is a schematic diagram of the present invention with two metal dioxide varistors.
Figure 7A:
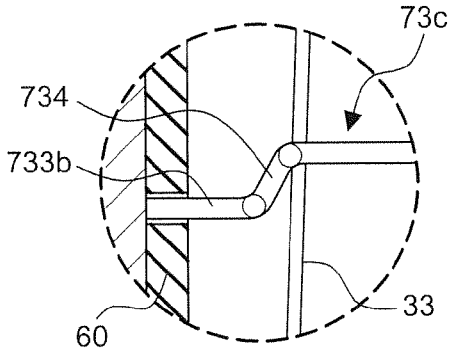
FIG. 7A is a partially enlarged view of FIG. 7.
Figure 8:
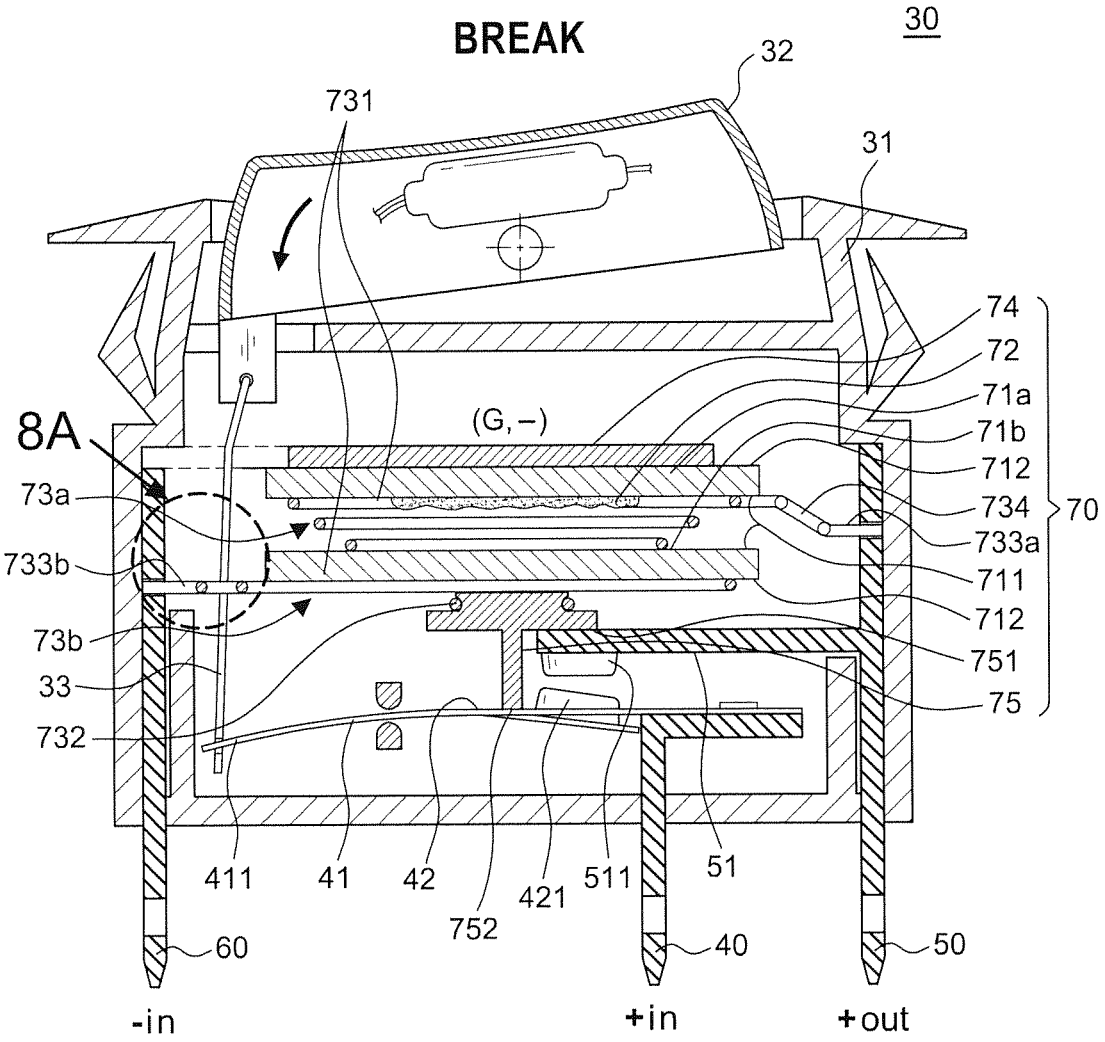
FIG. 8 is a schematic diagram illustrating the thermo-sensitive piece melting, loosening the spring element, displacing the pushing element, and further turning the switch off in FIG. 7.
Figure 9:
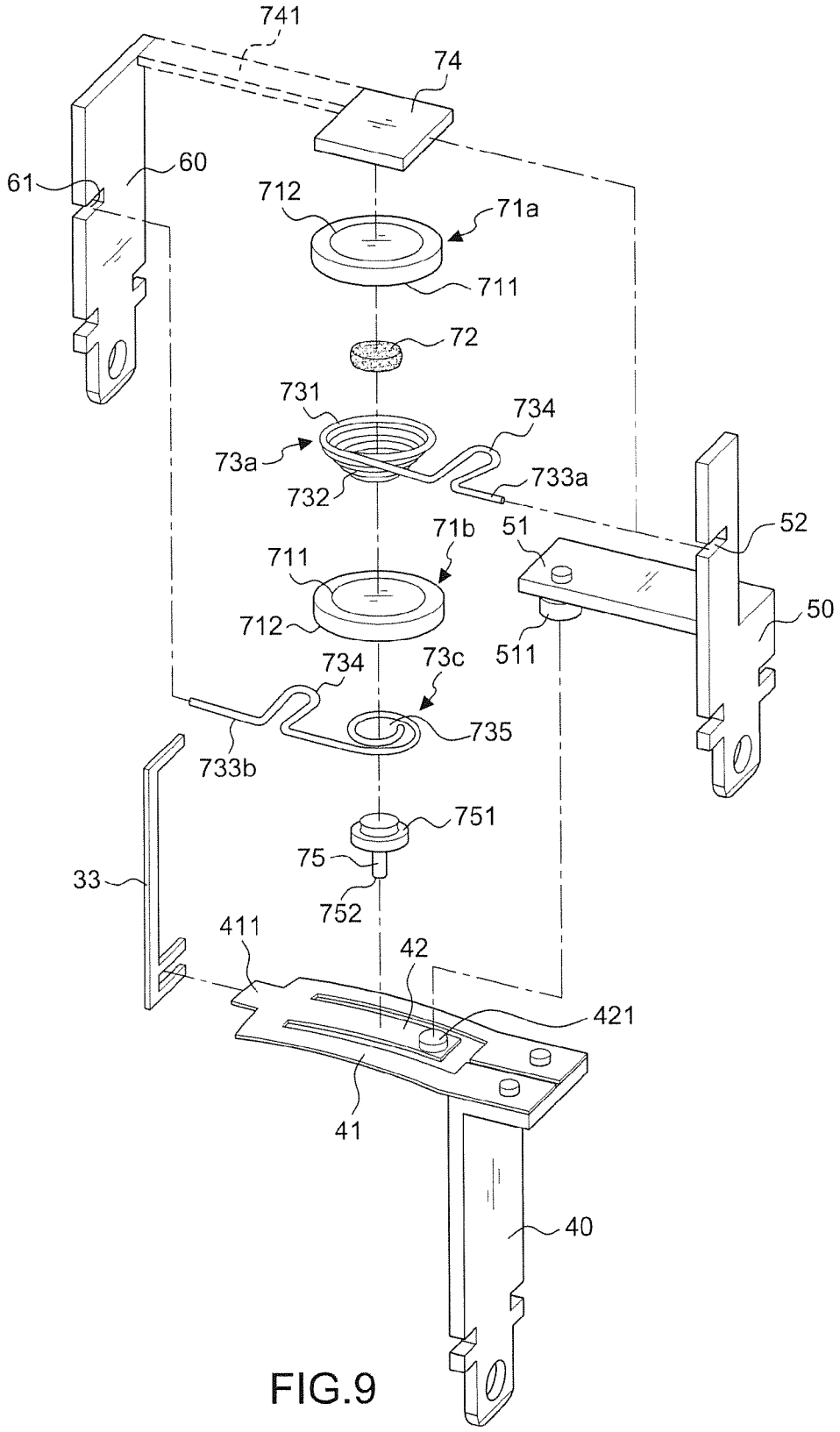
FIG. 9 is an exploded view of the major components of the present invention in a second embodiment.

FIGS. 7-9 illustrate an exploded view of the main elements of the present invention in a second embodiment. In this embodiment, the anti-surge disconnection structure 70 mainly comprises a first metal oxide varistor 71*a*, a second metal oxide varistor 71*b*, at least one spring element 73*a*, at least one thermo-sensitive piece 72, an electrical connector 73*c*, and a pushing element 75.

The first metal oxide varistor 71*a* is disposed under a plate 74 and has a first surface 711 and an opposite second surface 712. The spring element 73*a* has an a springy section 732 compressed on the first surface 711 of the first metal oxide varistor 71*a*, and an outer periphery 731 with a first extended portion 733*a* connecting the first surface 711 of the first metal oxide varistor 73*a* with the second conductive plate 50.

The thermo-sensitive piece 72 is solid colloid to be adhered on the first surface 711 of the first metal oxide varistor 71*a* for fixedly adhering the springy section 732 thereon for the spring element 73*a* to be ready for ejection. The second metal oxide varistors 71*b* has a first surface 711 compressing the spring element 73*a*. The electrical connector 73*c* is abutting on a second surface 712 of the second metal oxide varistor 71*b* and has a second extended portion 733*b* arranged aside for electrical connection between the second surface 712 of the second metal oxide varistor 71*b* and the third conductive plate 60. In this embodiment, the first extended portion 733*a* and the second extended portion 733*b* are arranged as bended portions 734 for respectively engaging a first slot 52 arranged on the second conductive plate 50 and a second slot 61 arranged on the third conductive plate 60 as shown in FIG. 9, so that when the spring element 73 is ejected, the bended portions 734 will provide stronger elasticity for ejection and then return to a straight status without affecting the operation.

The pushing element 75 has a first end 751 arranged correspondingly to the middle of the electrical connector 73*c* and the second surface 712 of the second metal oxide varistor 71*b*, and a second end 752 arranged correspondingly to the binary alloy conductive plate 41 for pushing. In this embodiment, the electrical connector 73*c* has a positioning hole 735 arranged in the middle thereof and the pushing element 75 is an isolated pushing rod; the first end 751 thereof is fixedly engaging the positioning hole 735 so that when the spring element 73 is ejected, the first connecting point 421 on the binary alloy conductive plate 41 would be forced to detach from the second connecting point 511, stopping the first metal oxide varistor 71*a* and the second metal oxide varistor 71*b* from heating up and stopping supplying electricity power for the device as well, as shown in FIG. 7.

Figure 8A:
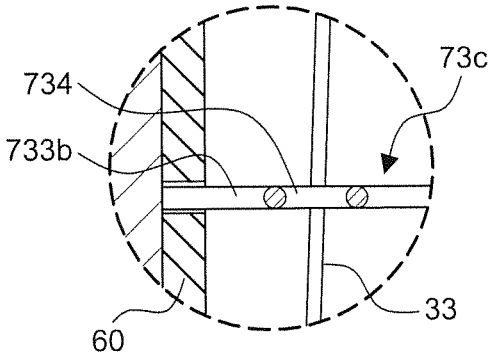
FIG. 8A is a partially enlarged view of FIG. 8.

FIG. 8 is a schematic diagram illustrating the thermo-sensitive piece melting, loosening the spring element, displacing the pushing element, and further turning the switch off in FIG. 7; and FIG. 8A is a partially enlarged view of FIG. 8. In this embodiment, the plate 74 does not have to be parallel connected to the third conductive plate 60; it is also applicable to connect the second extended portion 733*b* with the third conductive plate 60 and to have the plate 74 being the ground for connection.

Figure 10:
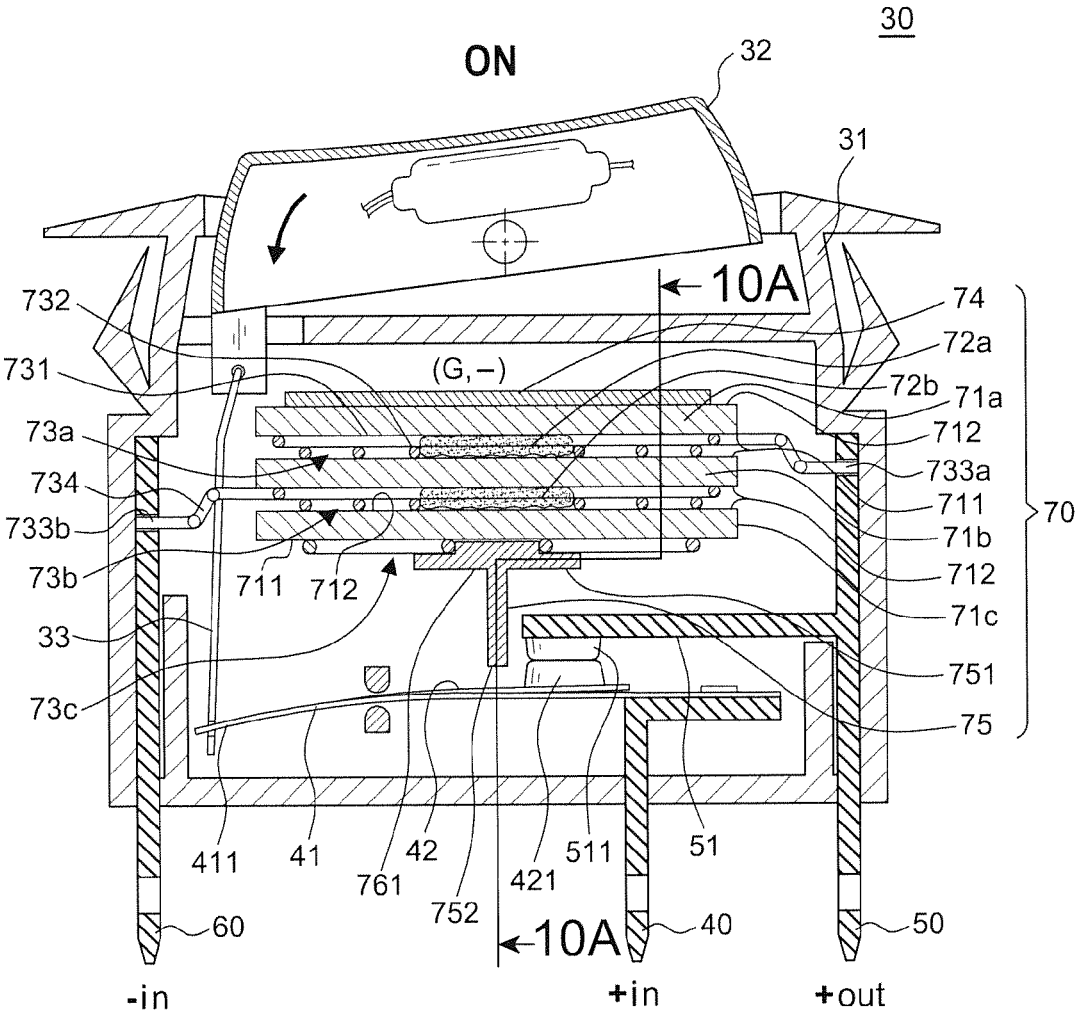
FIG. 10 a sectional view of the present invention in a third embodiment with three metal oxide varistors.
Figure 10A:
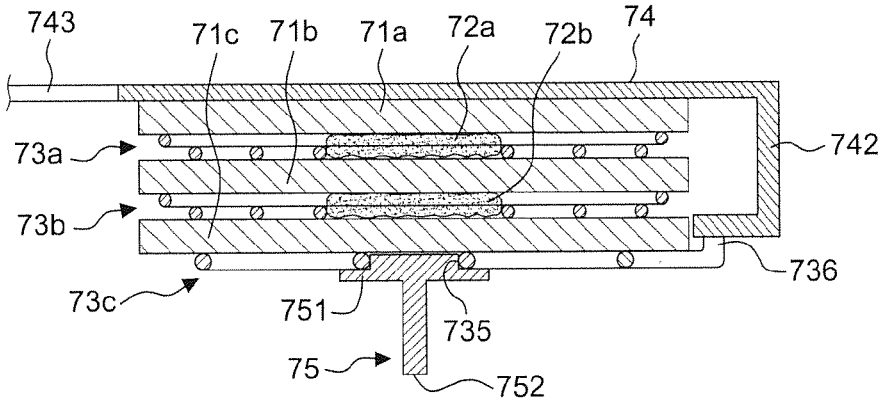
FIG. 10A is a sectional view along line 10A-10A in FIG. 10.
Figure 11:
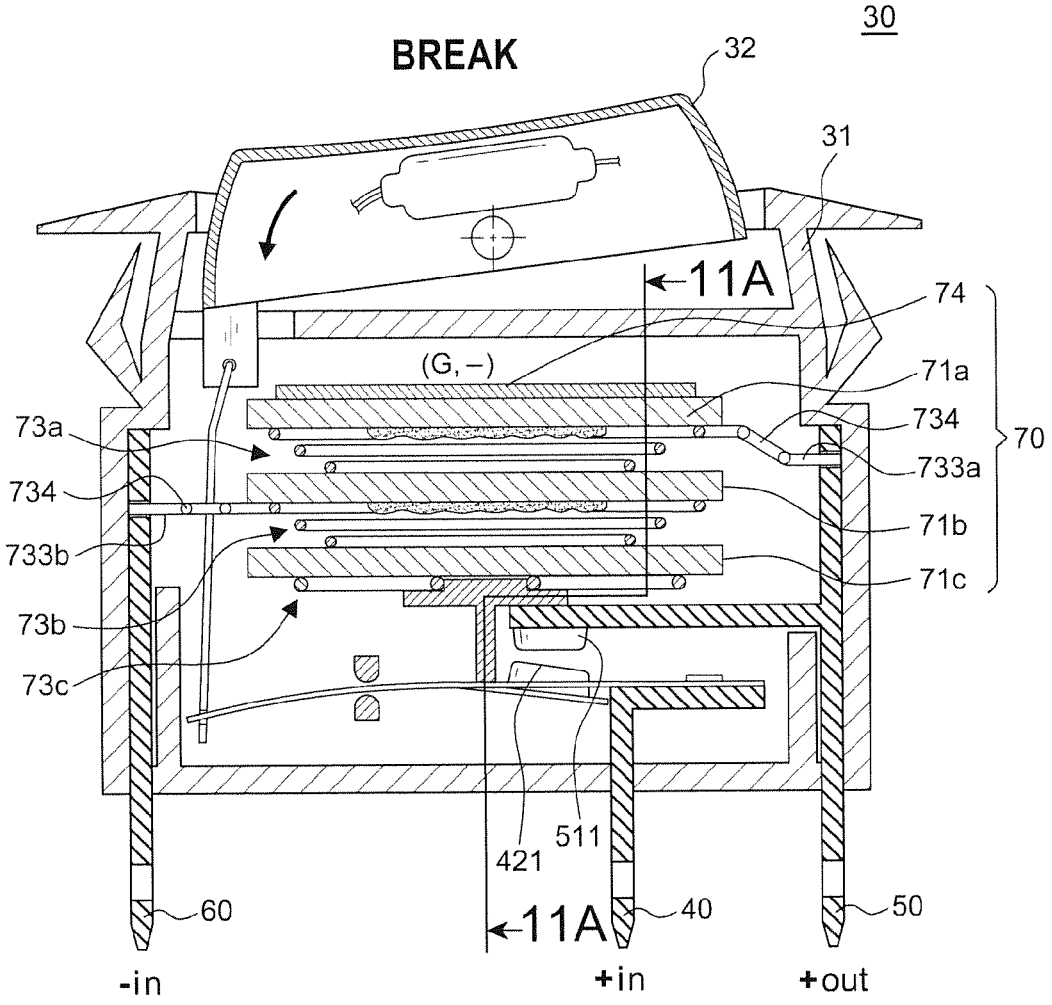
FIG. 11 is a schematic diagram illustrating the thermo-sensitive pieces melting, loosening the spring element, displacing the pushing element, and further turning the switch off in FIG. 10.
Figure 11A:
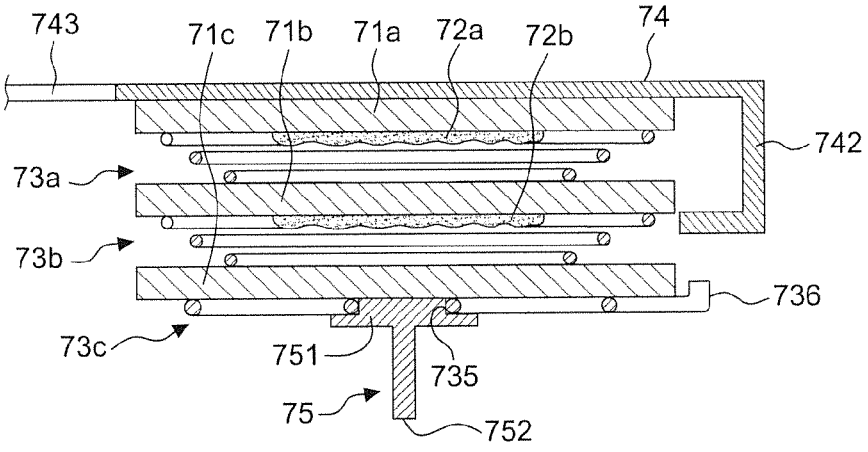
FIG. 11A is a sectional view along line 11A-11A in FIG. 11.
Figure 12:
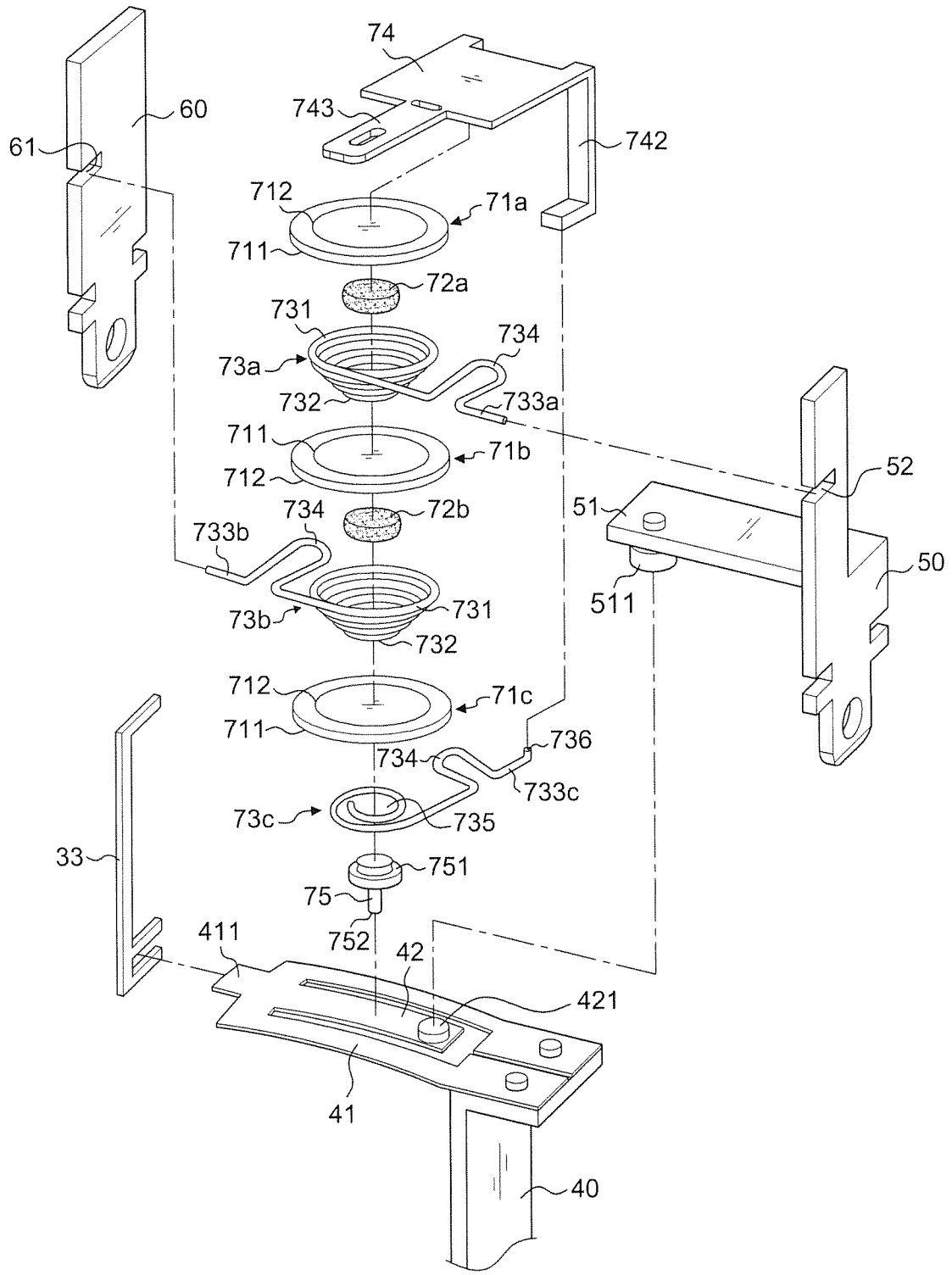
FIG. 12 is an exploded view of the major components of the present invention in a third embodiment.

FIGS. 10-12 illustrate a third embodiment of the present invention. In this embodiment, the anti-surge disconnection structure 70 mainly comprises a first metal oxide varistor 71*a*, a second metal oxide varistor 71*b*, a third metal oxide varistor 71*c*, a first spring element 73*a*, a second spring element 73*b*, a first thermo-sensitive piece 72*a*, a second thermo-sensitive piece 72*b*, an electrical connector 73*c*, and a pushing element 75.

The first thermo-sensitive piece 72*a* is solid colloid to be adhered on the first surface 711 of the first metal oxide varistor 71*a* for fixedly adhering the springy section 732 of the first spring element 73*a* on the first surface 711 of the first metal oxide varistor 71 for the first spring element 73*a* to be ready for ejection. The first spring element 73*a* further has an outer periphery 731 with a first extended portion 733*a* connecting the first surface 711 of the first metal oxide varistor 71 with the second conductive plate 50. The second metal oxide varistor 71*b* has a first surface 711 and an opposite second surface 712; the first surface 711 thereof is compressing the first spring element 73*a*. The second thermo-sensitive piece 72*b* is solid colloid to be adhered on the second surface 712 of the second metal oxide varistor 71*b* for fixedly adhering the springy section 732 of the second spring element 73*b* on the second surface 712 of the second metal oxide varistor 71*b* for the second spring element 73*b* to be ready for ejection. The second spring element 73*b* further has an outer periphery 731 with a second extended portion 733*b* connecting the second surface 712 of the second metal oxide varistor 71*b* with the third conductive plate 60. The third metal oxide varistor 73*c* has a first surface 711 and a opposite second surface 712 and the second surface 712 thereof is compressing the second spring element 73*b*. The electrical connector 73*c* is abutting on the first surface 711 of the third metal oxide varistor 71*c* and has a third extended portion 733*c* arranged aside for electrical connection between the third metal oxide varistor 71*c* and the plate 74. The pushing element 75 has a first end 751 arranged correspondingly to the middle of the electrical connector 73*c* and the first surface 711 of the third metal oxide varistor 71*c*, and a second end 752 arranged correspondingly to the binary alloy conductive plate 41 for pushing. In this embodiment, the plate 74 further has a conductive element 742 to be electrically connected to the electrical connector 73*c*, and the electrical connector 73*c* has a positioning hole 735 arranged in the middle thereof for engaging the first end 751 of the pushing element 75; the third extended portion 733*c* further has a contacting point 736 for contacting and simultaneously detaching from an bottom end of the conductive element 742.

In this embodiment, the first extended portion 733*a* and the second extended portion 733*b* are arranged as bended portions 734 for respectively engaging the second conductive plate 50 and the third conductive plate 60, so that when any of the thermo-sensitive pieces melts down and loosens the springy section 732 of either spring elements, the bended portions 734 would will provide strong elasticity for ejection and then return to a straight status without affecting the operation. The plate 74 may further have a fourth conductive plate 743 disposed aside and extended to the outside of the housing 31 (not shown) for further application.

With structures disclosed above, the present invention complements the defect of a conventional overcurrent protection switch that it has to connect to a metal oxide varistor and a thermal fuse from the outside by having an anti-surge disconnection structure 70 including at least one metal oxide varistor, at least one thermo-sensitive pieces, and at least spring element ingeniously built inside so that when receiving exceedingly high voltages, the heating metal oxide varistor would instantly melt the thermo-sensitive piece, counterbalancing the compressing force on the spring element and further displacing the pushing element, therefore forcing the connecting points to detach and turning off the switch immediately. Hence, the present invention has the original function of overcurrent protection and further has the overvoltage protection and anti-surge disconnection structures built inside, ensuring more electricity safety and conveniences in using.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A switch module of built-in anti-surge disconnection structure, comprising:

a housing having a press button arranged atop thereof, and a first conductive plate, a second conductive plate and a third conductive plate arranged at a lower section thereof; the first conductive plate being connected to a binary alloy conductive plate and having a first connecting point, and the second conductive plate having a second connecting point on the surface of an upper section thereof corresponding to the first connecting point;

a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

wherein an anti-surge disconnection structure is built inside the housing, including:

at least one metal oxide varistor being disposed under a plate and having a first surface and an opposite second surface;

at least one spring element having an outer periphery with an extended portion connecting the first surface of the metal oxide varistor with the second conductive plate, and a springy section being compressed on the first surface of the metal oxide varistor, the extended portion being arranged as a bended portion;

at least one thermo-sensitive piece being solid colloid to be adhered on the first surface of the metal oxide varistor for fixedly adhering the springy section of the spring element on the first surface of the metal oxide varistor for the spring element to be ready for ejection;

a pushing element having a first end thereof arranged correspondingly to the metal oxide varistor and the springy section of the spring element, and a second end thereof arranged correspondingly to the binary alloy conductive plate for pushing;

whereby when the first connecting point is contacting the second connecting point and an overvoltage occurs, the temperature of the metal oxide varistor would instantly rise up to a degree higher than the melting point thereof, therefore melting the thermo-sensitive piece, loosening the springy section of the spring element and displacing the pushing element to force the first connecting point detaching from the second connecting point and turn off the switch.

2. The switch module of built-in anti-surge disconnection structure as claimed in claim 1, wherein the second surface of the metal oxide varistor is connected to the third conductive plate by the plate and a conductive wire, and the plate and conductive wire are formed in one-piece with the third conductive plate.

3. The switch module of built-in anti-surge disconnection structure as claimed in claim 1, wherein the pushing element is an isolated pushing rod.

4. The switch module of built-in anti-surge disconnection structure as claimed in claim 1, wherein the pushing element is formed in one-piece with the spring element as a protruding section arranged at the front of the spring element.

* * * * *